US006666181B2

(12) United States Patent
Smith et al.

(10) Patent No.: US 6,666,181 B2
(45) Date of Patent: Dec. 23, 2003

(54) HYDRAULIC DETENT FOR A VARIABLE CAMSHAFT TIMING DEVICE

(75) Inventors: Franklin R. Smith, Cortland, NY (US); Braman Wing, Interlaken, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/376,900

(22) Filed: Feb. 28, 2003

(65) Prior Publication Data

US 2003/0196626 A1 Oct. 23, 2003

Related U.S. Application Data

(60) Provisional application No. 60/374,201, filed on Apr. 19, 2002.

(51) Int. Cl.[7] ..... F01L 1/34

(52) U.S. Cl. ..... 123/90.17; 123/90.16; 123/90.15; 92/120

(58) Field of Search ..... 123/90.17, 90.15–90.16; 92/120–125, 5 L

(56) References Cited

U.S. PATENT DOCUMENTS

| | | | | |
|---|---|---|---|---|
| 5,002,023 A | | 3/1991 | Butterfield et al. | 123/90.15 |
| 5,107,804 A | | 4/1992 | Becker et al. | 123/90.17 |
| 5,172,659 A | | 12/1992 | Butterfield et al. | 123/90.17 |
| 5,184,578 A | | 2/1993 | Quinn, Jr. et al. | 123/90.17 |
| 5,289,805 A | | 3/1994 | Quinn, Jr. et al. | 123/90.17 |
| 5,361,735 A | | 11/1994 | Butterfield et al. | 123/90.17 |
| 5,497,738 A | | 3/1996 | Siemon et al. | 123/90.17 |
| 5,507,254 A | * | 4/1996 | Melchior | 123/90.17 |
| 5,645,017 A | * | 7/1997 | Melchior | 123/41.15 |
| 5,649,506 A | * | 7/1997 | Melchior | 123/90.17 |
| 5,657,725 A | | 8/1997 | Butterfield et al. | 123/90.17 |
| 6,247,434 B1 | | 6/2001 | Simpson et al. | 123/90.17 |
| 6,250,265 B1 | | 6/2001 | Simpson | 123/90.17 |
| 6,263,846 B1 | | 7/2001 | Simpson et al. | 123/90.17 |
| 6,311,655 B1 | | 11/2001 | Simpson et al. | 123/90.17 |
| 6,374,787 B2 | | 4/2002 | Simpson et al. | 123/90.17 |
| 6,477,999 B1 | | 11/2002 | Markley | 123/90.17 |

* cited by examiner

*Primary Examiner*—Thomas Denion
*Assistant Examiner*—Kyle Riddle
(74) *Attorney, Agent, or Firm*—Brown & Michaels, PC; Greg Dziegielewski

(57) ABSTRACT

A phaser which includes a housing and a rotor disposed to rotate relative to each other is provided. The housing has at least one cavity disposed to be divided by a vane rigidly attached to the rotor. The vane divides the cavity into a first chamber and a second chamber. The phaser further includes passages connecting the first and the second chamber, thereby facilitating the oscillation of the vane within the cavity. The phaser includes: a) a valve disposed to form at least two openings for fluid flowing between the first chamber and the second chamber and being disposed to keep at least one opening closed; and b) at least one by-pass disposed to stop or slow down the rotation between the housing and the rotor, thereby allowing a locking mechanism to lock the housing and the rotor together independent of fluid flow.

8 Claims, 10 Drawing Sheets

HYDRAULIC DETENT FOR A VARIABLE CAMSHAFT TIMING DEVICE

REFERENCE TO RELATED APPLICATIONS

This application claims an invention which was disclosed in Provisional Application No. 60/374,201, filed Apr. 19, 2002, entitled "Hydraulic Detent for a Variable Camshaft Timing Device". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable camshaft timing (VCT) devices. More particularly, the invention pertains to a Hydraulic Detent for a Variable Camshaft Timing device, in which the hydraulic detent reduces noise by forming a bypass.

2. Description of Related Art

The performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

Consideration of information disclosed by the following U.S. Patents, which are all hereby incorporated by reference, is useful when exploring the background of the present invention.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position on of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from a hydraulic cylinder or other force multiplier which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

U.S. Pat. No. 5,289,805 provides an improved VCT method which utilizes a hydraulic PWM spool position control and an advanced control algorithm that yields a prescribed set point tracking behavior with a high degree of robustness.

In U.S. Pat. No. 5,361,735, a camshaft has a vane secured to an end for non-oscillating rotation. The camshaft also carries a timing belt driven pulley which can rotate with the camshaft but which is oscillatable with respect to the camshaft. The vane has opposed lobes which are received in opposed recesses, respectively, of the pulley. The camshaft tends to change in reaction to torque pulses which it experiences during its normal operation and it is permitted to advance or retard by selectively blocking or permitting the flow of engine oil from the recesses by controlling the position of a spool within a valve body of a control valve in response to a signal from an engine control unit. The spool is urged in a given direction by rotary linear motion translating means which is rotated by an electric motor, preferably of the stepper motor type.

U.S. Pat. No. 5,497,738 shows a control system which eliminates the hydraulic force on one end of a spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

U.S. Pat. No. 5,657,725 shows a control system which utilizes engine oil pressure for actuation. The system includes a camshaft has a vane secured to an end thereof for non-oscillating rotation therewith. The camshaft also carries a housing which can rotate with the camshaft but which is oscillatable with the camshaft. The vane has opposed lobes which are received in opposed recesses, respectively, of the housing. The recesses have greater circumferential extent than the lobes to permit the vane and housing to oscillate with respect to one another, and thereby permit the camshaft to change in phase relative to a crankshaft. The camshaft tends to change direction in reaction to engine oil pressure and/or camshaft torque pulses which it experiences during its normal operation, and it is permitted to either advance or retard by selectively blocking or permitting the flow of engine oil through the return lines from the recesses by controlling the position of a spool within a spool valve body in response to a signal indicative of an engine operating condition from an engine control unit. The spool is selectively positioned by controlling hydraulic loads on its opposed end in response to a signal from an engine control unit. The vane can be biased to an extreme position to provide a counteractive force to a unidirectionally acting frictional torque experienced by the camshaft during rotation.

U.S. Pat. No. 6,247,434 shows a multi-position variable camshaft timing system actuated by engine oil. Within the system, a hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,250,265 shows a variable valve timing system with actuator locking for internal combustion engine. The system comprising a variable camshaft timing system comprising a camshaft with a vane secured to the camshaft for rotation with the camshaft but not for oscillation with respect to the camshaft. The vane has a circumferentially extending plurality of lobes projecting radially outwardly therefrom and is surrounded by an annular housing that has a corresponding plurality of recesses each of which receives one of the lobes and has a circumferential extent greater than the circumferential extent of the lobe received therein to permit oscillation of the housing relative to the vane and the camshaft while the housing rotates with the camshaft and the vane. Oscillation of the housing relative to the vane and the camshaft is actuated by pressurized engine oil in each of the recesses on opposed sides of the lobe therein, the oil pressure in such recess being preferably derived in part from a torque pulse in the camshaft as it rotates during its operation. An annular locking plate is positioned coaxially with the camshaft and the annular housing and is moveable relative to the annular housing along a longitudinal central axis of the camshaft between a first position, where the locking plate engages the annular housing to prevent its circumferential movement relative to the vane and a second position where circumferential movement of the annular housing relative to the vane is permitted. The locking plate is biased by a spring toward its first position and is urged away from its first position toward its second position by engine oil pressure, to which it is exposed by a passage leading through the camshaft, when engine oil pressure is sufficiently high to overcome the spring biasing force, which is the only time when it is desired to change the relative positions of the annular housing and the vane. The movement of the locking plate is controlled by an engine electronic control unit either through a closed loop control system or an open loop control system.

U.S. Pat. No. 6,263,846 shows a control valve strategy for vane-type variable camshaft timing system. The strategy involves an internal combustion engine that includes a camshaft and hub secured to the camshaft for rotation therewith, where a housing circumscribes the hub and is rotatable with the hub and the camshaft, and is further oscillatable with respect to the hub and camshaft. Driving vanes are radially inwardly disposed in the housing and cooperate with the hub, while driven vanes are radially outwardly disposed in the hub to cooperate with the housing and also circumferentially alternate with the driving vanes to define circumferentially alternating advance and retard chambers. A configuration for controlling the oscillation of the housing relative to the hub includes an electronic engine control unit, and an advancing control valve that is responsive to the electronic engine control unit and that regulates engine oil pressure to and from the advance chambers. A retarding control valve responsive to the electronic engine control unit regulates engine oil pressure to and from the retard chambers. An advancing passage communicates engine oil pressure between the advancing control valve and the advance chambers, while a retarding passage communicates engine oil pressure between the retarding control valve and the retard chambers.

U.S. Pat. No. 6,311,655 shows multi-position variable cam timing system having a vane-mounted locking-piston device. An internal combustion engine having a camshaft and variable camshaft timing system, wherein a rotor is secured to the camshaft and is rotatable but non-oscillatable with respect to the camshaft is discribed. A housing circumscribes the rotor, is rotatable with both the rotor and the camshaft, and is further oscillatable with respect to both the rotor and the camshaft between a fully retarded position and a fully advanced position. A locking configuration prevents relative motion between the rotor and the housing, and is mounted within either the rotor or the housing, and is respectively and releasably engageable with the other of either the rotor and the housing in the fully retarded position, the fully advanced position, and in positions therebetween. The locking device includes a locking piston having keys terminating one end thereof, and serrations mounted opposite the keys on the locking piston for interlocking the rotor to the housing. A controlling configuration controls oscillation of the rotor relative to the housing.

U.S. Pat. No. 6,374,787 shows a multi-position variable camshaft timing system actuated by engine oil pressure. A hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,477,999 shows a camshaft that has a vane secured to an end thereof for non-oscillating rotation therewith. The camshaft also carries a sprocket that can rotate with the camshaft but is oscillatable with respect to the camshaft. The vane has opposed lobes that are received in opposed recesses, respectively, of the sprocket. The recesses have greater circumferential extent than the lobes to permit the vane and sprocket to oscillate with respect to one another. The camshaft phase tends to change in reaction to pulses that it experiences during its normal operation, and it is permitted to change only in a given direction, either to advance or retard, by selectively blocking or permitting the flow of pressurized hydraulic fluid, preferably engine oil, from the recesses by controlling the position of a spool within a valve body of a control valve. The sprocket has a passage extending therethrough the passage extending parallel to and being spaced from a longitudinal axis of rotation of the camshaft. A pin is slidable within the passage and is resiliently urged by a spring to a position where a free end of the pin projects beyond the passage. The vane carries a plate with a pocket, which is aligned with the passage in a predetermined sprocket to camshaft orientation. The pocket receives hydraulic fluid, and when the fluid pressure is at its normal operating level, there will be sufficient pressure within the pocket to keep the free end of the pin from entering the pocket. At low levels of hydraulic pressure, however, the free end of the pin will enter the pocket and latch the camshaft and the sprocket together in a predetermined orientation.

The vane which subdivides the housing into advance and retard chambers tends to oscillate within a cavity defined by the housing. For example, the oscillation may be caused by cam torque characteristic. As the rotor rotates, the vane tends to touch or being physically stopped by the portions of the housing. This touching or stoppage causes undesirable noise. Therefore, it is desirous to having a means for reducing the undesirable noise by placing the vane in a suitable position for the reduction of noises.

SUMMARY OF THE INVENTION

In a VCT phaser having rotor with a center positioned spool valve formed therein, the rotor having at least one vane forming an integral extension thereof, a middle position is provided for the vane whereby the vane is locked.

In a VCT phaser having rotor with a center positioned spool valve, a hydraulic bypass is provided whereby a vane that oscillates within a housing is placed in a predetermined middle position.

In a cam torque actuated (CTA) VCT phaser having rotor with a center positioned spool valve, a hydraulic bypass is provided whereby a vane that oscillates within a housing is placed in a predetermined middle position.

In a cam torque actuated (CTA) VCT phaser having rotor with a center positioned spool valve, at least one hydraulic bypass is provided whereby a vane that oscillates within a housing is placed in a predetermined middle position.

In an oil pressure actuated (OPA) VCT phaser having rotor with a center positioned spool valve, a hydraulic bypass is provided whereby a vane that oscillates within a housing is placed in a predetermined middle position.

In an oil pressure actuated (OPA) VCT phaser having rotor with a center positioned spool valve, at least one hydraulic bypass is provided whereby a vane that oscillates within a housing is placed in a predetermined middle position.

In a cam torque actuated (CTA) VCT phaser having rotor with a center positioned spool valve, a hydraulic bypass is provided whereby a vane that oscillates within a housing is placed in a predetermined middle position. Furthermore, added restriction is provided to the exhaust port when the bypass circuit is open thereby further reducing the undesirable oscillation.

In a cam torque actuated (CTA) VCT phaser having rotor with a center positioned spool valve, at least one hydraulic bypass is provided whereby a vane that oscillates within a housing is placed in a predetermined middle position. Furthermore, added restriction is provided to the exhaust port when the bypass circuit is open thereby further reducing the undesirable oscillation.

In an oil pressure actuated (OPA) VCT phaser having rotor with a center positioned spool valve, a pair of hydraulic bypasses is provided for per vane to oscillate within a housing thereby placing the vane in a predetermined middle position.

In a cam torque actuated (CTA) VCT phaser having rotor with a center positioned spool valve, a pair of hydraulic bypasses is provided for per vane to oscillate within a housing thereby placing the vane in a predetermined middle position.

In a VCT phaser a bi-directional or two bypass passage structure is provided to reach the "detent" position very rapidly from either direction.

Accordingly, a phaser which includes a housing and a rotor disposed to rotate relative to each other is provided. The housing has at least one cavity disposed to be divided by a vane rigidly attached to the rotor. The vane divides the cavity into a first chamber and a second chamber. The phaser further includes passages connecting the first and the second chamber, thereby facilitating the oscillation of the vane within the cavity. The phaser comprises: a) a valve disposed to form at least two openings for fluid flowing between the first chamber and the second chamber and being disposed to keep at least one opening closed; and b) at least one by-pass disposed to stop or slow down the rotation between the housing and the rotor, thereby allowing a locking mechanism to lock the housing and the rotor together independent of fluid flow.

Accordingly, a phaser which includes a housing and a rotor disposed to rotate relative to each other is provided. The housing has at least one cavity disposed to be divided by a vane rigidly attached to the rotor. The vane divides the cavity into a first chamber and a second chamber. The phaser further includes passages connecting the first and the second chamber, thereby facilitating the oscillation of the vane within the cavity. A method is provided which includes the steps of: a) providing a valve disposed to form at least two openings for fluid flowing between the first chamber and the second chamber and being disposed to keep at least one opening closed; and b) providing at least one bypass disposed to stop or slow down the rotation between the housing and the rotor, thereby allowing a locking mechanism to lock the housing and the rotor together independent of fluid flow.

DETAILED DESCRIPTION OF THE INVENTION

Figure 1:
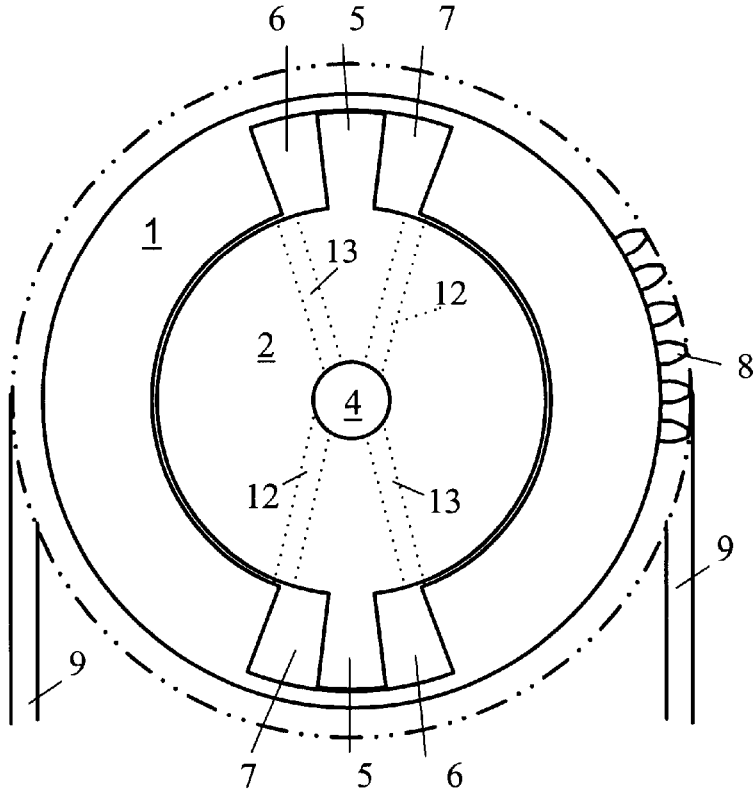
FIG. 1 shows a schematic of a phaser.

Referring to FIG. 1, a vane-type VCT phaser comprises a housing (1), the outside of which has sprocket teeth (8) which mesh with and are driven by timing chain (9). Inside the housing (1), a cavity including fluid chambers (6) and (7) is defined. Coaxially within the housing (1), free to rotate relative to the housing, is a rotor (2) with vanes (5) which fit between the chambers (6) and (7), and a central control valve (4) which routes pressurized oil via passages (12) and (13) to chambers (6) and (7), respectively. Pressurized oil introduced by valve (4) into passages (12) will push vanes (5) counterclockwise relative to the housing (1), forcing oil out of chambers (6) into passages (13) and into valve (4). It will be recognized by one skilled in the art that this description is common to vane phasers in general, and the specific arrangement of vanes, chambers, passages and valves shown in FIG. 1 may be varied within the teachings of the invention. For example, the number of vanes and their location can be changed, some phasers have only a single vane, others as many as a dozen, and the vanes might be located on the housing and reciprocate within chambers on the rotor. The housing might be driven by a chain or belt or gears, and the sprocket teeth might be gear teeth or a toothed pulley for a belt.

Figure 2:
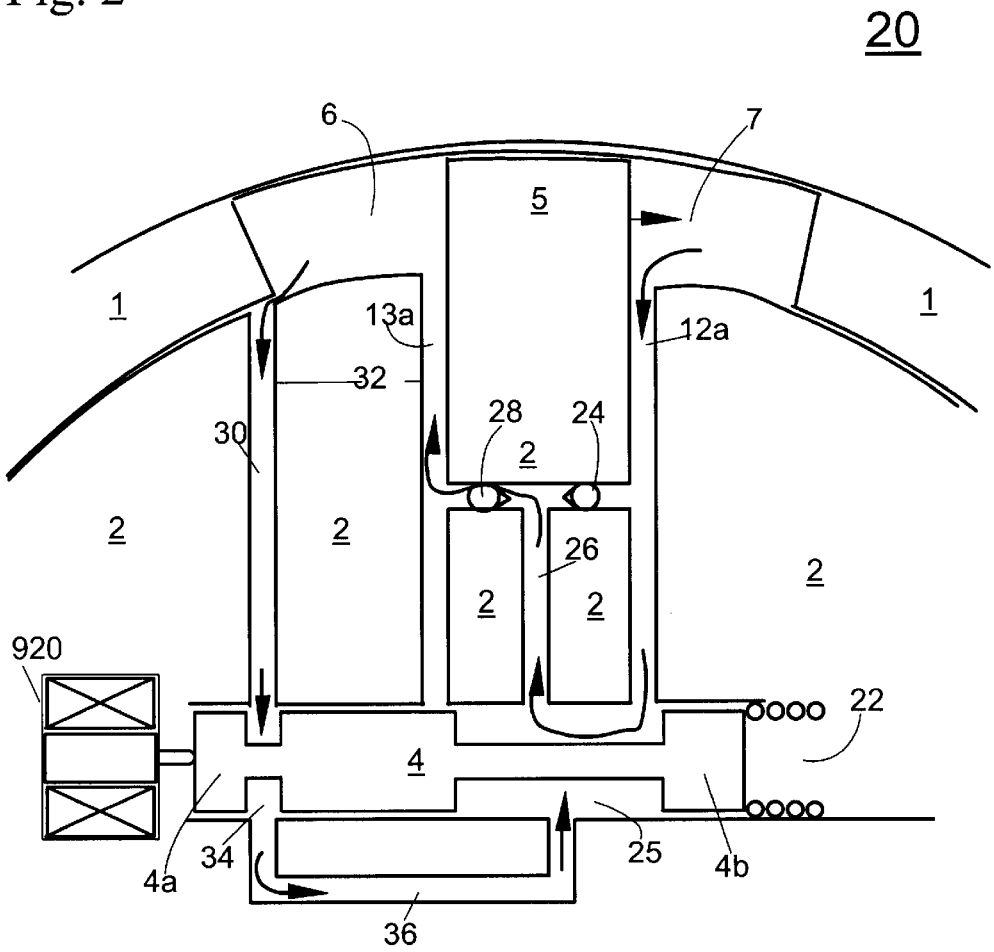
FIG. 2 shows the present invention used in a CTA type VCT system.
Figure 3:
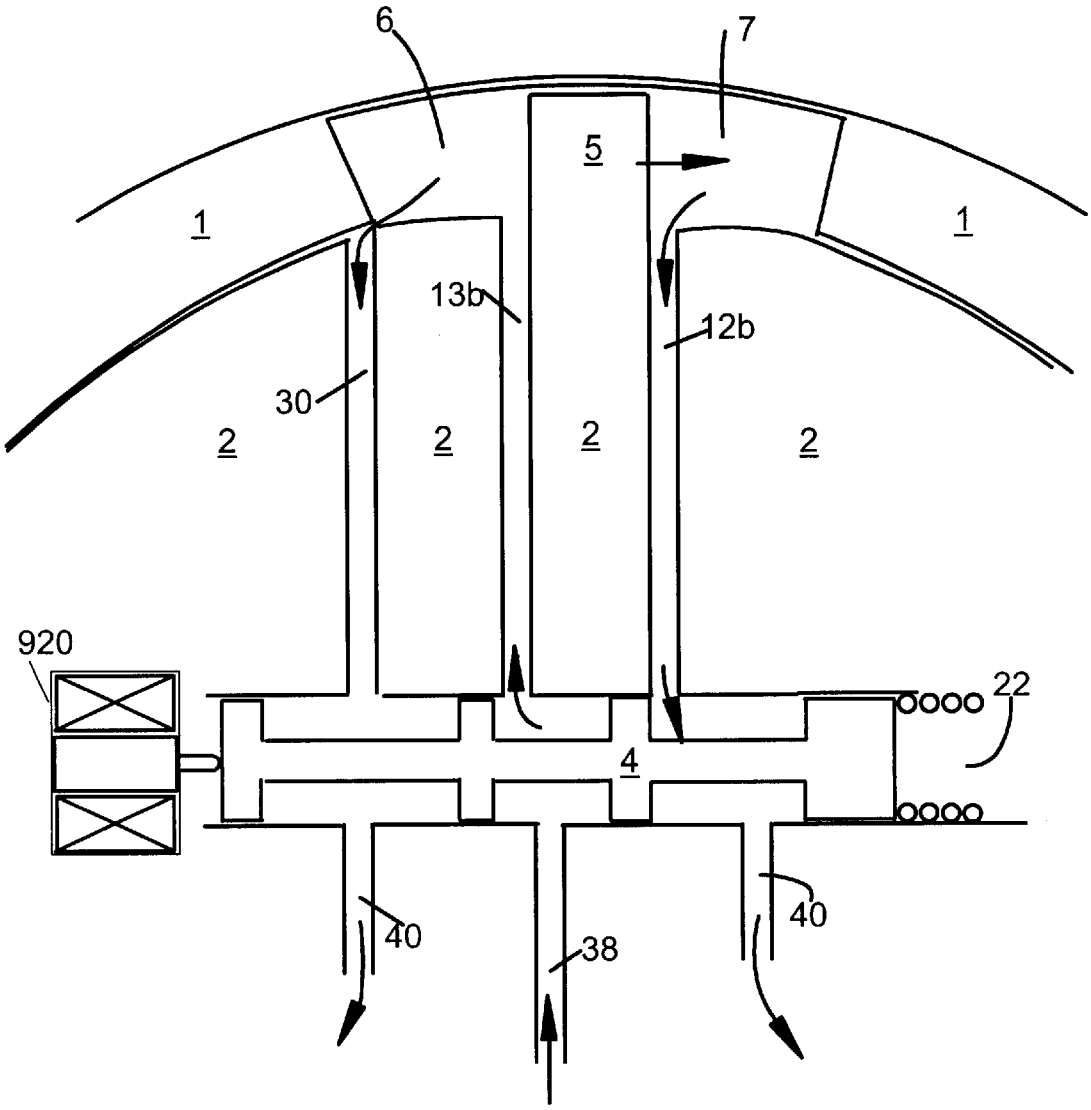
FIG. 3 shows the present invention used in an oil pressure actuated VCT system.

FIGS. 2 and 3 describe the phaser of the present invention in detail. Referring now to FIG. 2, a typical hydraulic schematic of a Cam Torque Actuated VCT mechanism (20) is depicted. A more detailed schematic of passages **(12*a*) and (13*a*) to chambers (6) and (7) is shown. As the rotor (2) rotates clockwise, vane (5) rotates along with the same since it is rigidly attached thereto. An actuator (920) deposed to be controlled by a controller (not shown) position the valve (4) such as a spool valve as shown for completing a set of fluid circuits. By engaging spool valve (4) via a force exerted upon a first end (4*a*) of spool valve (4), an equilibrium position can be achieved by an equal force exerted upon a second end (4*b*) of spool (4) by means of an elastic member (22) such as a spring. Because of the CTA mechanism, fluid flows out of chamber (7) via passage (12*a*), check valve (24) stops the fluid flow therethrough, but the fluid circuit is still complete by having fluid flowing from passage (12*a*) through a first opening (25) caused by the positioning of valve (4) into passage (26). A substantial amount of fluid in passage (26) flows through check valve (28) into chamber (6). The end result of the above described fluid flow is that the rotor (2), the vane (5) rotates in relation to housing (1). More specifically, vane (5) moves clockwise within the cavity of housing (1) in the clockwise direction as the result of the above described fluid flow. A fluid by-pass (30) is introduced which is disposed to prevent vane (5) from moving any further clockwise. The mechanism of preventing the vane (5) from moving further is achieved as follows. When rotor (2) rotates clockwise in relation to housing (1), chamber (6) is filling up at the expense of fluid coming from chamber (7). In other words, without the introduction of fluid by-pass (30), chamber (6) has substantially a net gain and chamber (7) has substantially a net loss. With the introduction of fluid by-pass (30), chamber (6) starts a fluid out flow. The out flowing fluid from chamber (6) flows through fluid by-pass (30) through a second opening (34) caused by valve (4). The out flowing fluid continues flowing through passage (36) back into first opening (25). As can be appreciated, the end result of the above out flow of fluid stops the rotation of rotor (2) relative to housing (1) or at least slows down the rotation sufficiently enough in a middle position for a locking mechanism to lock the housing (1) and the rotor (2)** at this middle position thereby the middle position is maintained independent of fluid flow. The locking mechanism may be any type which is not part of the present invention.

In the practice of the present invention, a bypass circuit including the fluid by-pass (30) is formed to stop the movement of vane (5) or at least slow the movement of same sufficiently to apply a locking mechanism. Furthermore, it should be noted that the position of the fluid by-pass (30) may be suitably disposed to allow a desired middle position of the vane (5) within the cavity. For example, the dimensional relationship between fluid by-pass (30) fluid flow mechanisms including passages **(12*a*, 13*a*) can be predetermined so that the middle position is preset. More specifically, a distance (32) may be predetermined for a preset middle position. It is further noted that the shape of spool (4) are suitably formed to permit desired fluid flow and maintain the null position. It is still further noted that fluid by-pass (30) may be formed with the rotor (2) or it may be formed independent of rotor (2)**.

Upon inspection of FIG. 2 it will be seen that without the bypass circuit the VCT is commanded to advance or retard (or hold position) based on the position of the spool valve (4) which may be located at the center of the VCT rotor (2). The spool valve (4) determines the direction and rate of change of phase but typically requires a position feed back sensor on the camshaft in order to stop in a specific mid phase position. At this juncture, it is desirous to keep the specific mid-phase position independent of oil flow. Numerous known VCT mechanisms have adopted a locking pin that locks the VCT phaser during conditions where the engine oil pump is not supplying any oil to the VCT such as during the engine cranking cycle. These locking pins are typically located at either extreme mechanical stop within the VCT mechanism. The VCT can operate in the "open loop" mode and be commanded to the stop where the locking pin will engage. The mechanical stop positions the rotor in the proper position for the locking pin to reliably engage.

This invention overcomes the limitation of requiring vane (5) to come to a mechanical stop in order to provide a locked position. The present invention further allows the VCT system or phaser to find a mid phase position in open loop control mode where a locking pin can be aligned for reliable engagement.

In the case of a cam torque actuated device as depicted in FIG. 2, when the spool valve is set to one end of stroke the fluid such as oil is allowed to exhaust from one chamber and fill another, e.g. from the first chamber to the second chamber. If the fluid is exhausted from the retard chamber and allowed to fill the advance chamber, the camshaft will reach the advance phase position. For example, chamber (6) may be advance chamber and chamber (7) accordingly is the retard chamber. By opening a bypass circuit from the advance chamber back to the retard chamber the advance chamber will only fill to a certain level, then the fluid will leak out through the bypass circuit. The position of the bypass hole disposed to be in fluid communication with chamber (6) determines the relative phase angle at which locking occurs.

Referring to FIG. 3 for oil pressure actuated VCT mechanisms. The theory of operation is the same, i.e. the bypass circuit (30) limits the filling of the chamber (6) to determine the mid phase position. The difference is that the bypass circuit would be exhausted to a sump or a sink instead of exhausting internally as with the Cam Torque Actuated VCT. Furthermore, known oil pressure actuated VCT mechanisms other than the bypass circuit (30) are used in order to achieve the desired effect. For example, a source (38) supplying fluid is introduced, a pair of exhaust passages (40), and suitable passages **(12*b*, 13*b*)** with their respective circuits are introduced.

Figure 4:
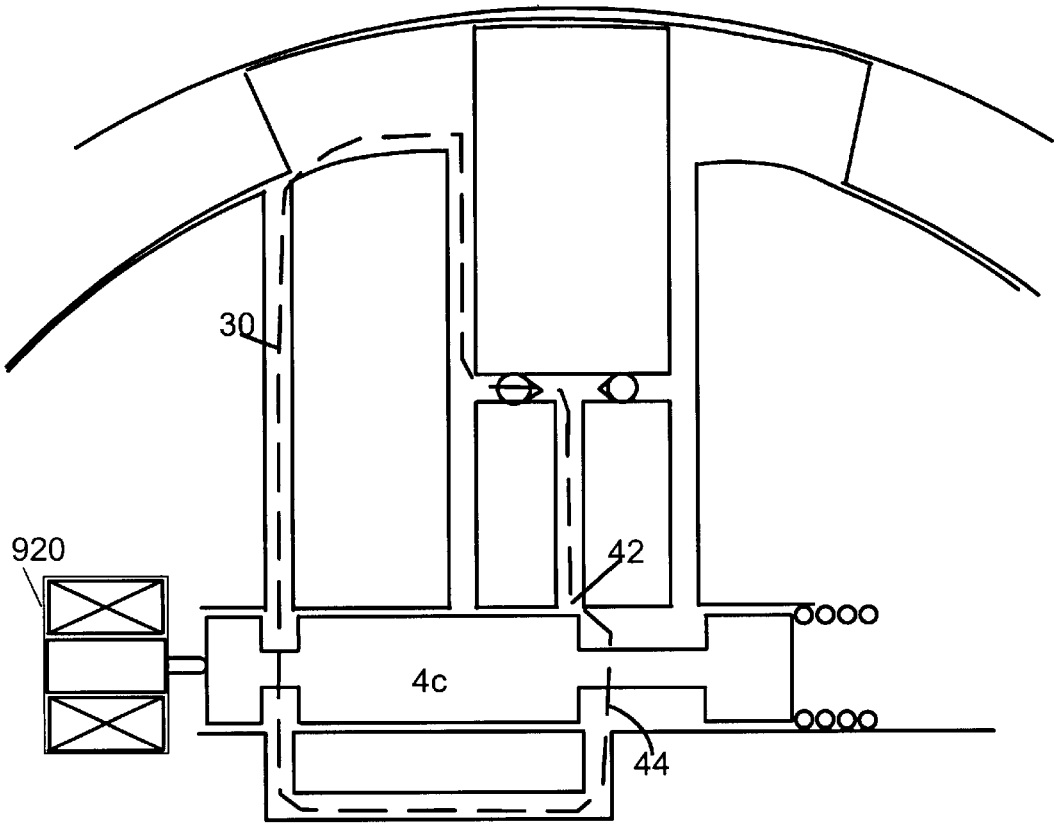
FIG. 4 shows an improved embodiment of FIG. 2.

FIG. 4 is a modification of FIG. 2. A restriction is added to the exhaust port (42) when the bypass circuit (44) is open. This will slow the actuation rate to the mid position but simultaneously also producing less oscillation when the mid position is reached. In this case, the restriction is achieved by forming an extended spool portion as compared to FIG. 2.

Figure 5:
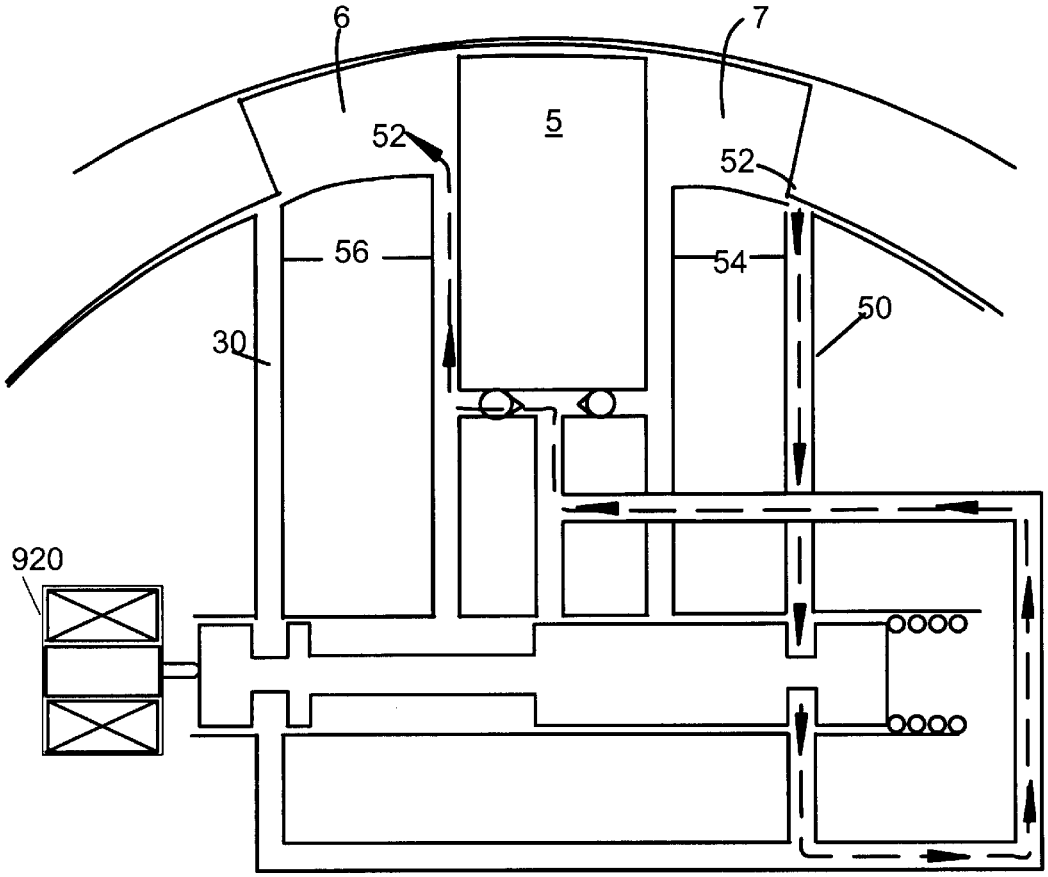
FIG. 5 shows a first improved embodiment of the present invention.

In FIG. 5, a second by-pass (50) adds a bi-directional or two bypass embodiment structure is further added. The operation of the two bypass embodiment is similar to operations of the previous embodiments, except that the two bypasses structure allows the phaser to reach the "detent" position more rapidly from either direction.

Referring now in detail to FIG. 5, a two bypass structure in a phaser at its detent position is shown. As can be seen, at the detent position both passages, i.e., passage (30) LA and passage (50) contribute to maintenance of the middle position. The operation of reaching the detent position is as follows. When vane (5) is biased toward left, i.e., before detent position is reached, no fluid flow occurs in passage (30) in that no fluid communication occurs with chamber (6). It is noted that the biased toward right scenario is not shown herein FIG. 5. However, one can assume or imagine said scenario immediately before the detent position is reached. At this juncture, passage (50) maintains fluid communication between chambers (6, 7) by way of a fluid circuit (52). Fluid circuit (52) is maintained until detent or middle position is reached. Similarly, a fluid circuit (not shown) traversing through passage (30) occurs if vane (5) is biased toward right until detent position is reached. As shown in FIG. 5, both passages (30, 50) are in fluid communication with chambers (6, 7), whereby a balance is maintained.

Figure 6:
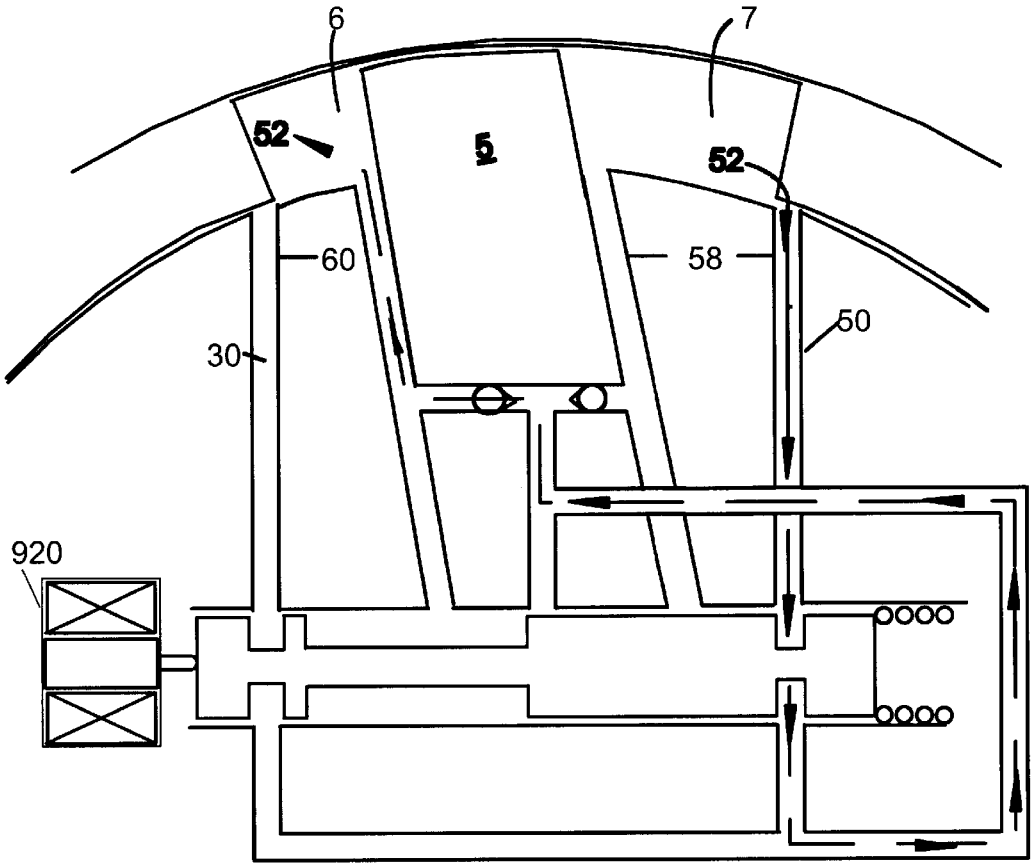
FIG. 6 shows a second improved embodiment of the present invention.

It is noted that in FIG. 5, the desired middle position happens to be in the center point of the cavity within housing (1) by defining dimension (54) to be identical with dimension (56). But the middle position can be any suitable location within housing (1) varying dimension (54) and dimension (56) respectively as shown in FIG. 6. The operations of FIG. 6 are substantially similar to that of FIG. 5, exception the location of the middle position caused by the difference of dimensions (58) and (60) respectively.

It is further noted that FIGS. 5 and 6 depicts a (CTA) VCT system. But the bi-directional therein is application to other VCT system such as (OPA) VCT system. In addition, FIGS. 5 and 6 are partially schematic showings of the present invention, therefore, the actual physical structural relationships may not be as shown.

Figure 7:
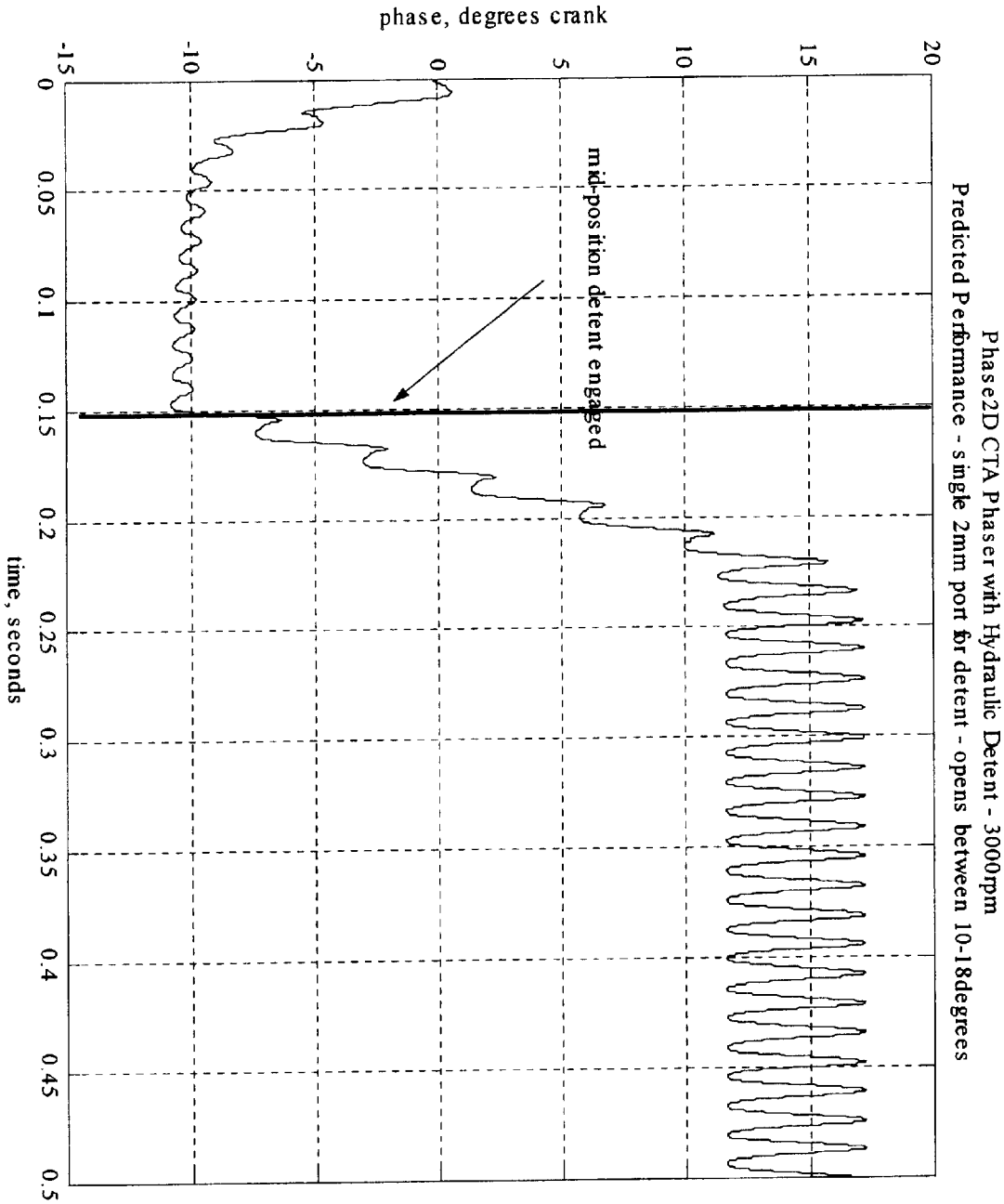
FIG. 7 shows experimental data without dual passages.
Figure 8:
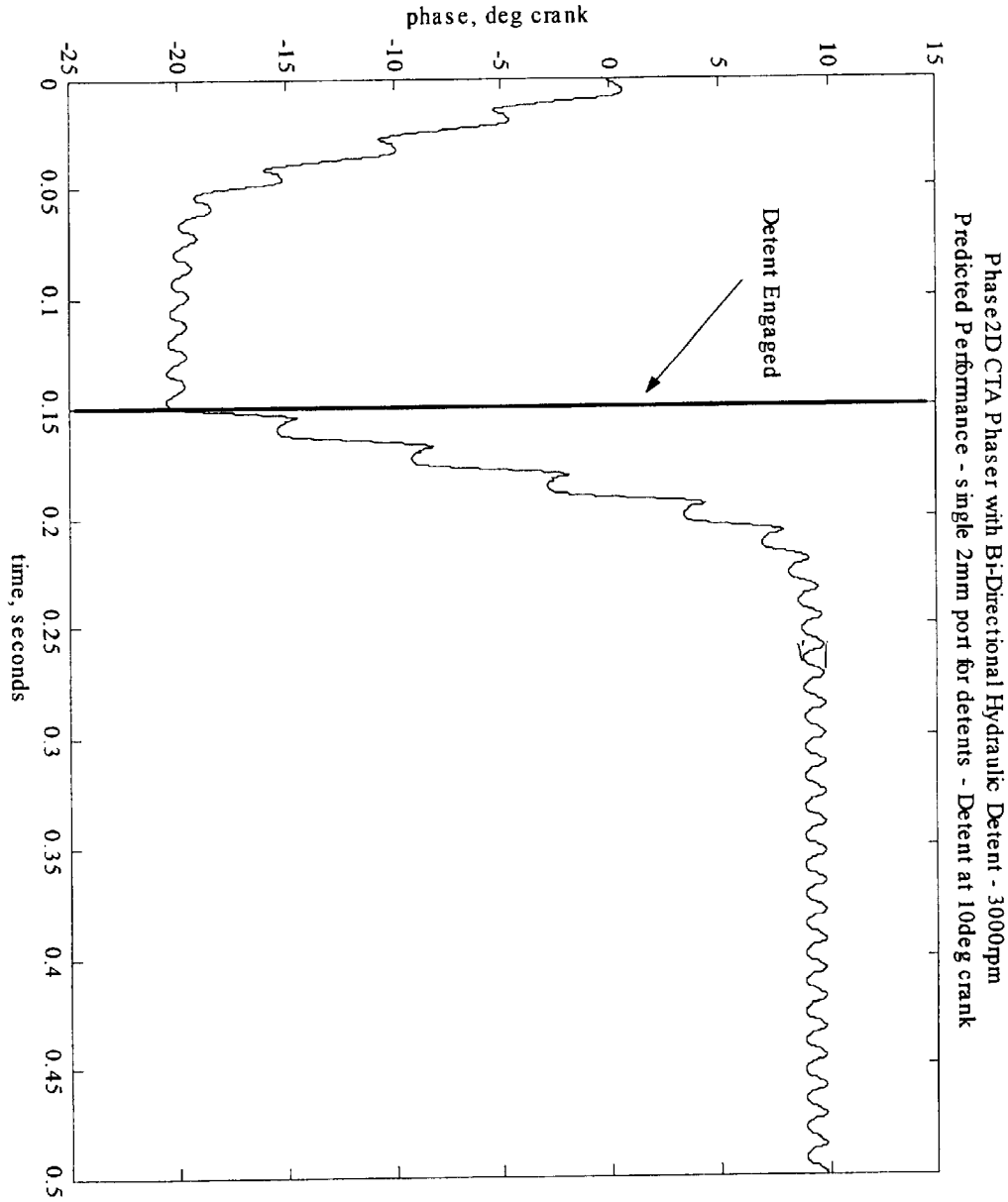
FIG. 8 shows experimental data with dual passages.
Figure 9:
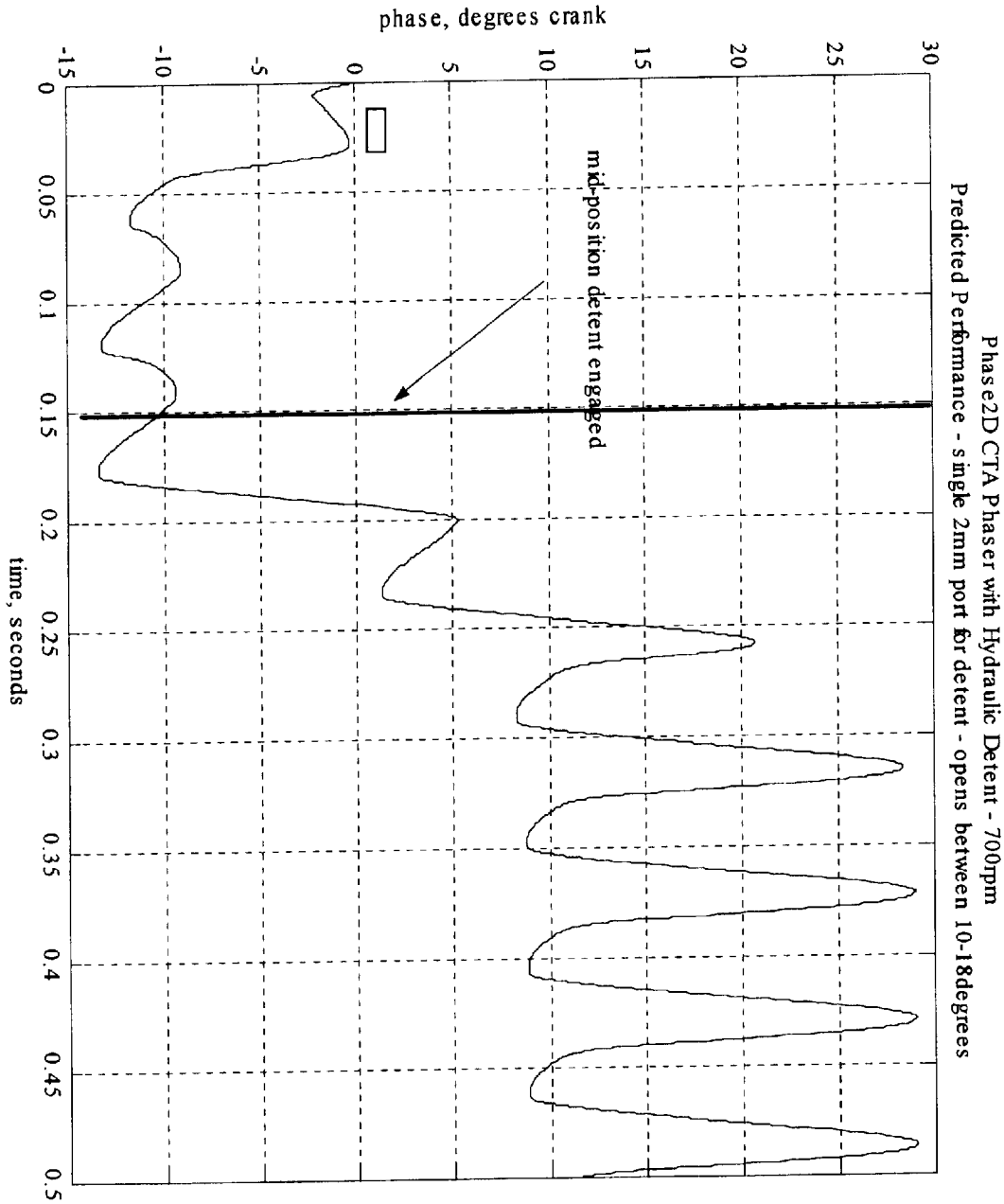
FIG. 9 shows experimental data at a different engine speed without dual passages.
Figure 10:
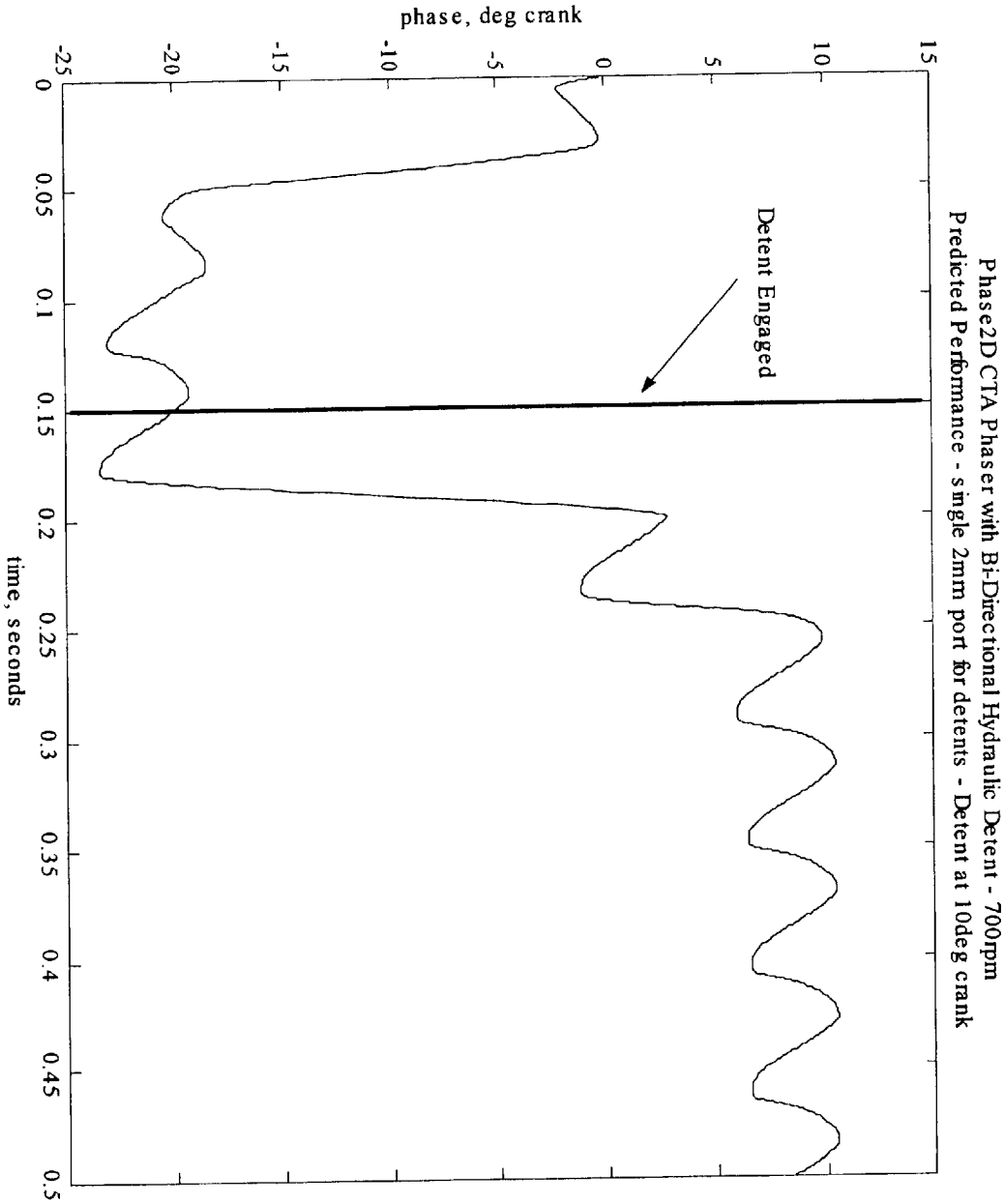
FIG. 10 shows experimental data at a different engine speed with dual passages.

FIGS. 7–10 are experimental data showing the improvement of the bi-directional or bi-passage structure over single passage structure. FIG. 7 shows a CTA phaser model with single passage and FIG. 8 shows CTA phaser model with double passages or bi-directional passages. Note the amplitude variations after the mid-position detent is engaged. As can be seen, FIG. 8 has reduced amplitude variations compared to FIG. 7. The result of the reduced amplitude variations is manifested in less a chance for the vane (5) to come in contact with the housing (1) thereby reducing undesirable noise. FIGS. 9–10 show similar results at lower engine speeds.

The following are terms and concepts relating to the present invention.

A middle position of the vane is defined as a position wherein the side of the vane is not touching any side wall of the cavity of the housing.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA)VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. Vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

Chamber is defined as a space within which vane rotates, chamber may be divided into advance chamber (makes valves open sooner relative to crankshaft) and retard chamber (makes valves open later relative to crankshaft). Check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). Control valve is a valve which controls flow of fluid to phaser. The control valve may exist within the phaser in CTA system. Control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is most often located on center axis of rotor of a phaser.

Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). Valve Control Unit (VCU) is a control circuitry for controlling the VCT system. Typically the VCU acts in response to commands from ECU.

Driven shaft is any shaft which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

Housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". Lock pin is disposed to lock a phaser in position. Usually lock pin is used when oil pressure is too low to hold phaser, as during engine start or shutdown.

Oil Pressure Actuated (OPA) VCT system uses a conventional phaser, where engine oil pressure is applied to one side of the vane or the other to move the vane.

Open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. Rotor is the inner part of the phaser, which is attached to a cam shaft.

Pulse-width Modulation (PWM) provides a varying force or pressure by changing the timing of on/off pulses of current or fluid pressure. Solenoid is an electrical actuator which uses electrical current flowing in coil to move a mechanical arm. Variable force solenoid (VFS) is a solenoid whose actuating force can be varied, usually by PWM of supply current. VFS is opposed to an on/off (all or nothing) solenoid.

Sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

Torsion Assist (TA)or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A phaser including a housing and a rotor disposed to rotate relative to each other, the housing having at least one cavity disposed to be divided by a vane rigidly attached to the rotor, the vane dividing the cavity into a first chamber and a second chamber, the phaser further including passages connecting the first and the second chamber facilitating the oscillation of the vane within the cavity, the phaser comprising:

a) a valve disposed to form at least two openings for fluid flowing between the first chamber and the second chamber and being disposed to keep at least one opening closed; and b) at least one by-pass disposed to stop or slow down the rotation between the housing and the rotor, thereby allowing a locking mechanism to lock the housing and the rotor together independent of fluid flow.

2. The phaser of claim 1, wherein the by-pass is formed within the rotor.

3. The phaser of claim 1, wherein the by-pass is formed at a predetermined distance in relation to the passages connecting the first and the second chamber.

4. The phaser of claim 1, wherein two by-passes are provided per cavity.

5. A phaser including a housing and a rotor disposed to rotate relative to each other, the housing having at least one cavity disposed to be divided by a vane rigidly attached to the rotor, the vane dividing the cavity into a first chamber and a second chamber, the phaser further including passages connecting the first and the second chamber facilitating the oscillation of the vane within the cavity, a method comprising the steps of:

a) providing a valve disposed to form at least two openings for fluid flowing between the first chamber and the second chamber and being disposed to keep at least one opening closed; and b) providing at least one by-pass disposed to stop or slow down the rotation between the housing and the rotor, thereby allowing a locking mechanism to lock the housing and the rotor together independent of fluid flow.

6. The method of claim 5, wherein the by-pass is formed within the rotor.

7. The method of claim 5, wherein the by-pass is formed at a predetermined distance in relation to the passages connecting the first and the second chamber.

8. The method of claim 5, wherein two by-passes are provided per cavity.

* * * * *